US005624112A

United States Patent [19]

Hummel et al.

[11] Patent Number: 5,624,112

[45] Date of Patent: Apr. 29, 1997

[54] PORTABLE PITCHING MOUND BASE

[76] Inventors: Gregory Hummel; Robert Kurschinski, both of 265 Lexington Ct. P.O. Box 337, Waterloo, Ontario, Canada, N2J 4A8

[21] Appl. No.: 549,333

[22] Filed: Oct. 27, 1995

[51] Int. Cl.[6] ..... A63B 71/00

[52] U.S. Cl. ..... 473/497

[58] Field of Search ..... 273/25

[56] References Cited

U.S. PATENT DOCUMENTS

| | | | |
|---|---|---|---|
| 2,156,469 | 5/1939 | Boltz | 273/25 |
| 3,236,520 | 2/1966 | Friedman | 273/26 R |
| 3,479,028 | 11/1969 | Goeders | 273/25 |
| 3,703,285 | 11/1972 | Perry | 273/25 |
| 4,063,729 | 12/1977 | Hollaway | 273/25 |
| 4,306,718 | 12/1981 | Goeders | 273/25 |
| 4,749,223 | 6/1988 | Goeders | 273/25 |
| 4,925,186 | 5/1990 | Stevenson et al. | 273/25 |
| 5,213,323 | 5/1993 | Novinsky | 273/25 |

*Primary Examiner*—William H. Grieb
*Attorney, Agent, or Firm*—Suiter & Associates PC

[57] ABSTRACT

A portable pitching mound base has a network of structural elements with a flat bottom and generally circular periphery providing support for a cover which presents a flat top in the center and inclined sides sloping downward towards the periphery. The base is made in two halves with structural partitions at the dividing plane having access ports to allow lifting means such as a forklift, truck. The cover may be made of sheet material with metal mesh or with sheet aluminum having surrounding ridges to hold the overlying dirt of a pitcher's mound.

12 Claims, 5 Drawing Sheets

SECTION 5-5

SECTION 6-6

PORTABLE PITCHING MOUND BASE

This invention relates to improvements for the design of playing field facilities. In particular, it relates to an improved design for a portable pitching mound base for baseball fields.

Recreational playing fields, such as those found in Municipal parks;, are often used for a multitude of purposes such as football, soccer, lacrosse, track and field events, as well as baseball, softball, fastball, and the like.

Most of these games are preferably played on flat relatively smooth grass or ground. Baseball, however, unlike other sports, and unlike related games, such as softball and fastball, is played on a "diamond" in which the pitcher's position is located on a "pitching mound" which is generally dome-shaped, roughly round or circular, raised area in the middle of the field. This mound, which is necessary to the proper playing of baseball, is inconvenient, dangerous and inappropriate for other games, including related games such as fastball and softball which may be played on a very similar diamond.

Although it would be obvious to modify the field to suit the game, the placement of a dirt mound for baseball and its removal for other sports is a difficult, time-consuming, and expensive operation.

It is therefore desirable to provide a pitching mound which may be placed in position on a baseball diamond and removed relatively easily.

A single structure of this nature, because of its shape and lateral extent, is very awkward to handle and very heavy to lift.

Several attempts have been made to create mounds of sectional interlocking pieces, but these often require elaborately constructed or moulded shapes so that the pieces will fit together without moving when they are covered by dirt or used by baseball players. A mound which is merely a dome-shaped structure is inadequate because a proper pitching mound is meant to be a dirt surface. Elaborately interlocking pieces are difficult to use in connection with a dirt surface because the connecting surface has become impregnated with dirt and do not fit well.

Other designs which are composed of a series of interlocking pieces of manageable weight are subject to being unlawfully removed and replacement pieces are difficult to obtain.

For these and other reasons the present invention is designed to provide a portable, removable, pitcher's mound base which may be installed on a baseball diamond and removed with relative ease. The design is also intended to provide a pitcher's mound base which is relatively sturdy, can be covered with dirt, and is difficult to remove by unauthorized persons.

These objects and other advantages are sought to be achieved by the present invention which provides a portable base for a pitcher's mound comprising a pattern of structural elements having a flat bottom plane and a generally circular circumference and a covering supported by this structural element capable of supporting a layer of dirt, said cover presenting a generally level top in the centre and having inclined sides sloping downwards towards the bottom plane at the circumference. Preferably, the base is constructed in two parts along a vertical plane from side to side with a structural partition in each part adjacent the dividing plane. Ideally, each structural partition has access openings to receive lifting means such as the tynes of a forklift truck. The cover may be constructed of sheet material with a metal mesh fabric or may be covered with sheet aluminum having a pattern of ridges around the inclined sides so as to hold the overlying dirt in position.

The invention may be better understood by a description of one embodiment as illustrated in the attached drawings in which.

Figure 1:
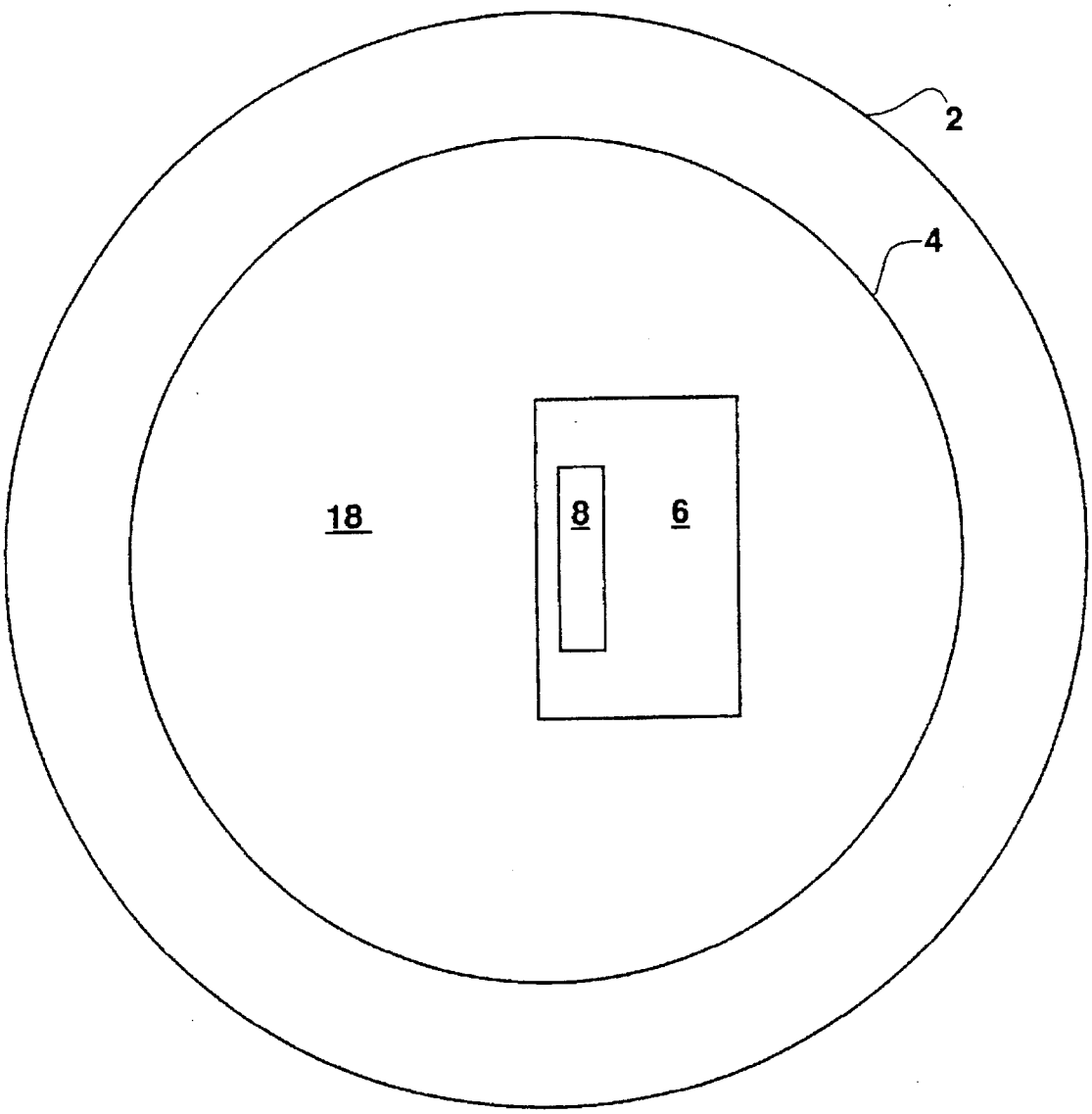
FIG. 1 is a plan view of a pitcher's mound incorporating an embodiment off the present invention.

In the embodiment illustrated in FIG. 1, the outer periphery of the mound (meaning the dirt surface) is represented by a circle 2 and the circumference of the underlying base beneath the dirt is represented by the circle 4. The top of the mound bas a generally flat area 6 in the centre with a pitcher's "rubber" 8 located thereon.

Figure 2:
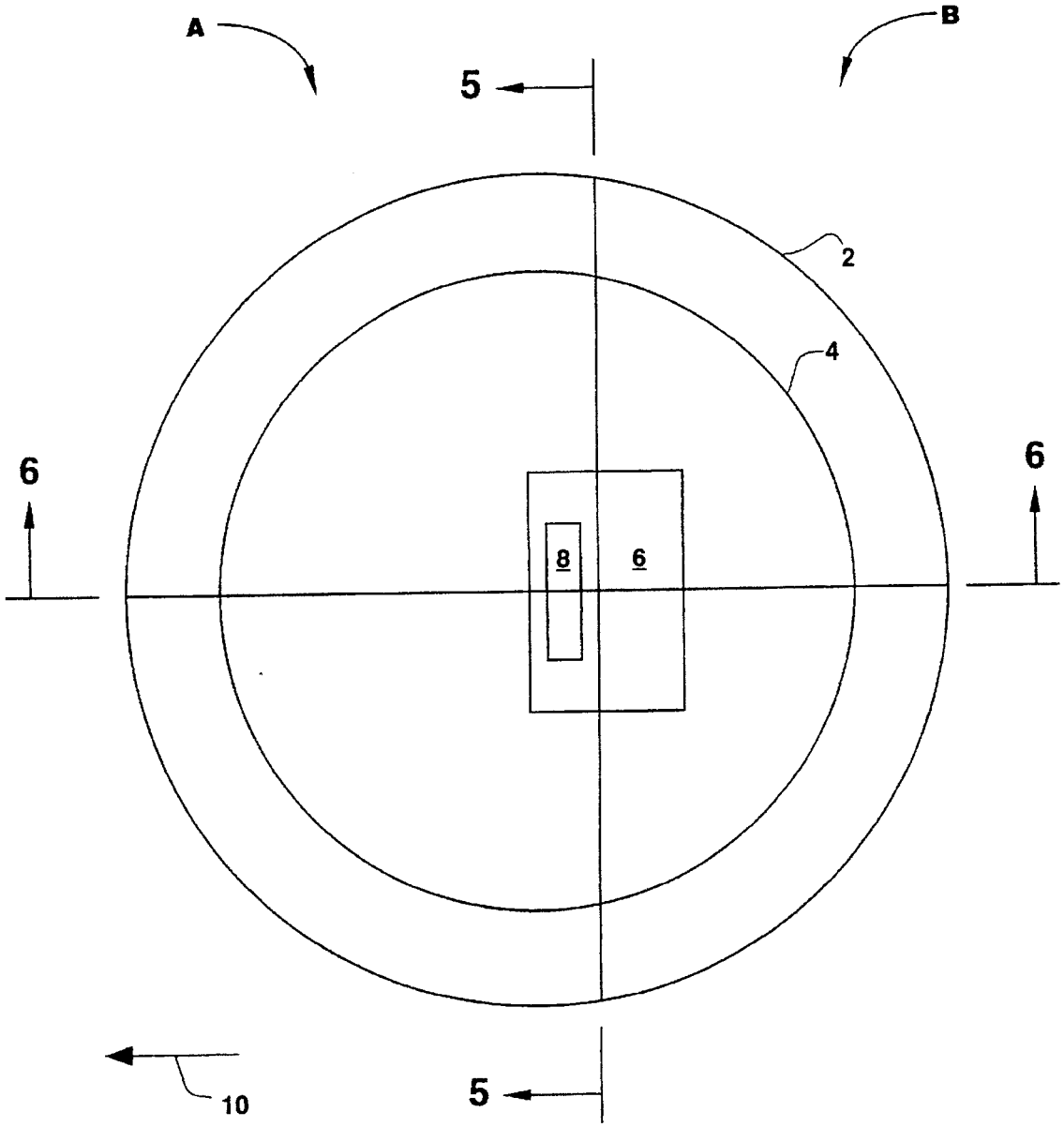
FIG. 2 is a plan view of a pitcher's mound such as shown in FIG. 1 with the location of cross-section views indicated.

In FIG. 2 the same mound and base are illustrated but the arrow 10 represents the orientation and direction towards home plate of a baseball diamond. In addition, the location of cross-sectional views discussed later are indicated. Although the invention is not restricted to specific dimensions, it is intended that the preferred embodiments will conform with the standards which are generally used or prescribed by baseball rules.

In FIG. 2 it can be seen that near the centre of the mound is a pitcher's rubber 8 approximately 24 inches×6 inches. The overall mound has a radius of about 9 feet (or diameter of 18 feet). The flat portion 6 at the top is approximately 5 feet across and 3 feet 4 inches in depth (in the pitcher's direction).

Figure 3:
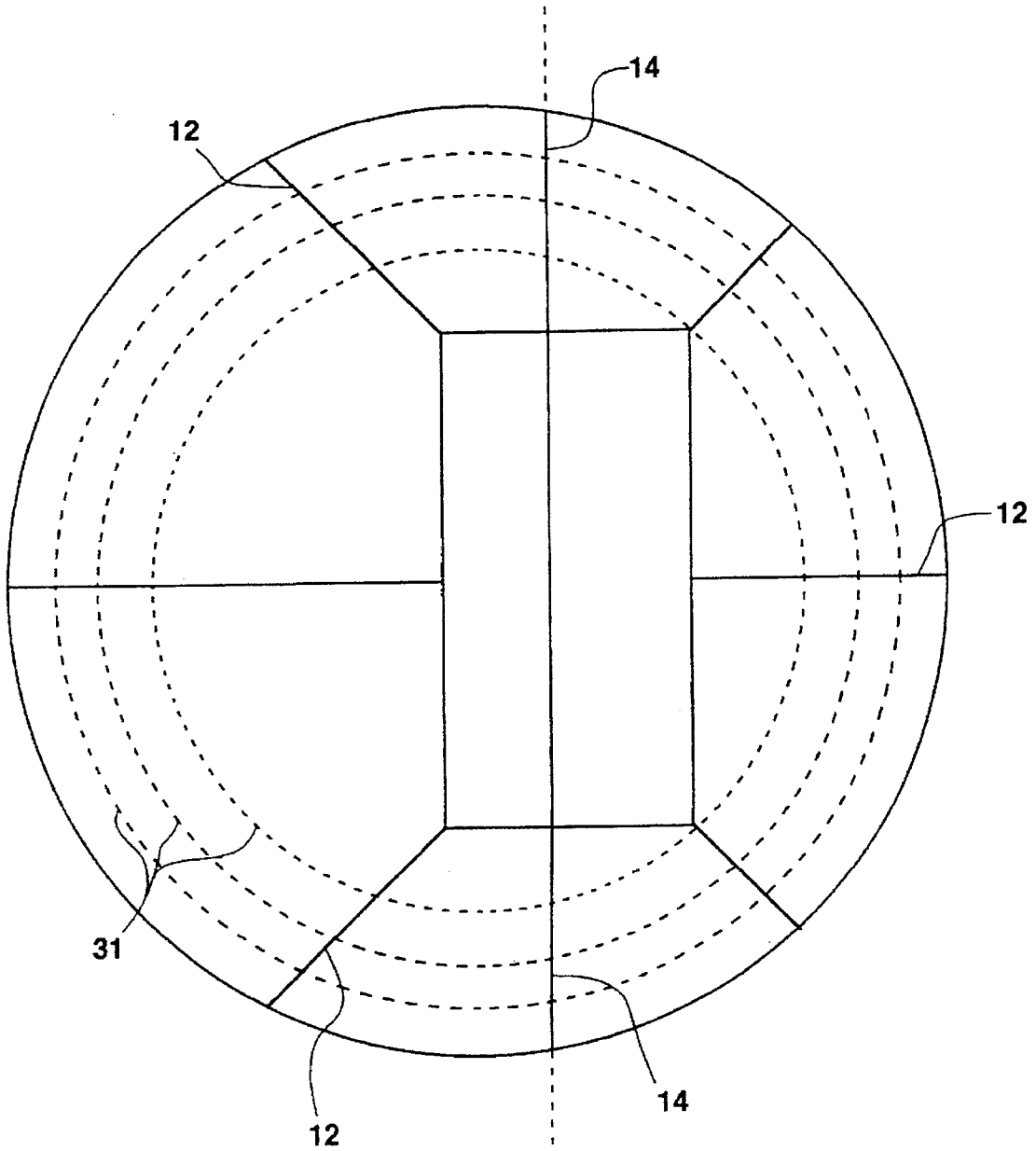
FIG. 3 is a plan view of the mound in FIG. 1 with the structural elements indicated.
Figure 4:
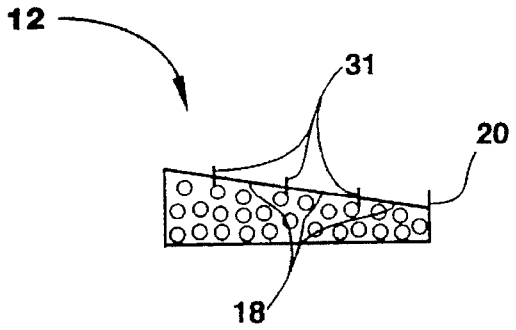
FIG. 4 is an elevation view of a structural element of the mound base shown in FIG. 1.

In FIG. 3 the substructure or base of the mound is illustrated with the location of the structural elements such as 12 shown. FIG. 4 illustrates an example of the strut 12 which may be made out of metal, plastic, or wood, or such other structural material, and may have holes in the struts to make them lighter.

Also illustrated in FIG. 3 is a dividing line 14 which separates the front portion of the base A which slopes towards home plate from the rear portion B which slopes towards the out field. Thus, the base for the pitcher's mound is constructed in two parts as described, and for reasons explained later.

Also illustrated in FIG. 3 is a series of circular, concentric rings 31 composed of upstanding ridges of barriers illustrated in the cross-section of FIG. 4. These ridges provide restraint to hold the soil which is subsequently used to cover the base and helps to maintain it in position and prevent it from sliding down the slope.

Figure 5:
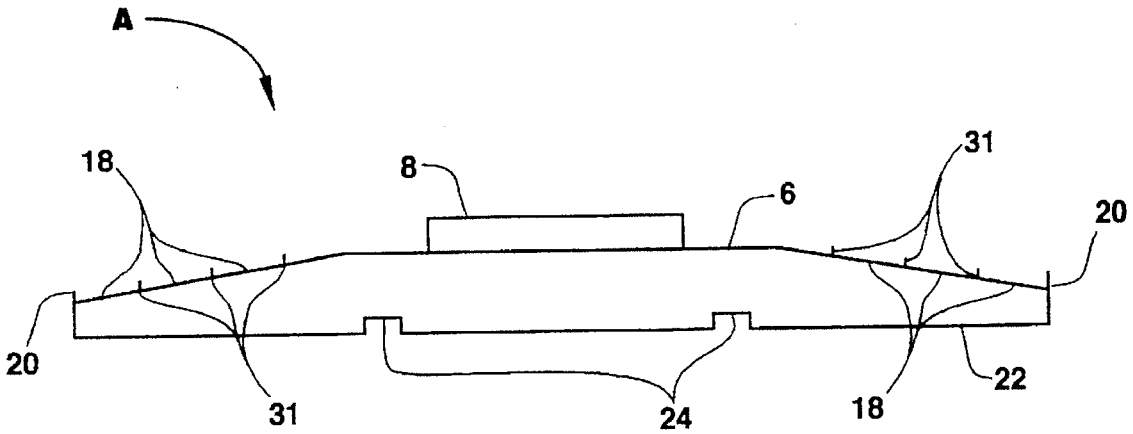
FIG. 5 is an elevation of the front portion of the mound base along the line 5—5 in FIG. 1.

FIG. 5 is a vertical elevation view, from the rear, of the forward portion A at the line 14 in FIG. 2. In this view the rear wall or partition of the front section A is shown at 16 with the flat top portion 6 surmounted by the pitching rubber 8 and having inclined side surfaces 18 which terminate against brief upstanding perimeter wall 20. The whole section has a floor 22 underlying the entire substructure.

Furthermore, the rear wall 16 has a pair of openings 24 which represent the opening of a pair of tunnels 26 adapted to receive the tynes of a forklift truck which may be used to lift the section and move it about.

Figure 6:
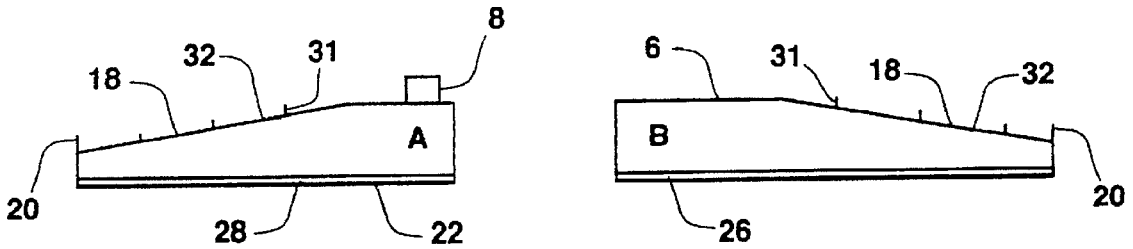
FIG. 6 is a separated cross-sectional view of the mound base along the line 6—6 in FIG. 1.

FIG. 6 is a cross-sectional view along the lines 6—6 in FIG. 2 showing the floor 22 and the inclined sides 18 with the pitcher's rubber 8 on top of the horizontal portion 6.

For illustrative purposes, the front portion A is shown separated from the rear portion B and in each portion the tunnels for receiving the tynes of a forklift truck are illustrated at 26 and 28 respectively. The dividing wall or partition of the rear portion B is illustrated at 30 and it will be understood that when the base is assembled, this will match and abut the dividing wall 16 of the front portion A.

Figure 7:
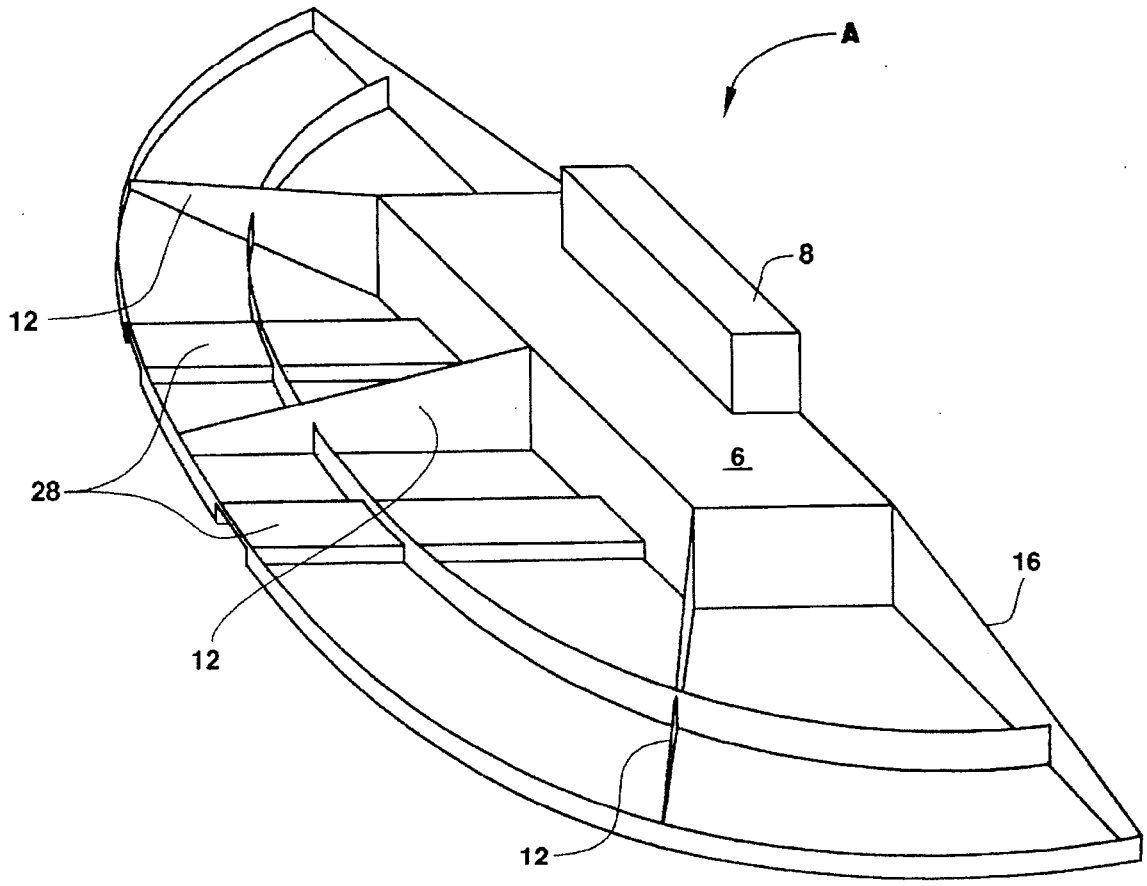
FIG. 7 is a perspective view of the substructure of the front portion of the mound base in FIG. 1.

FIG. 7 illustrates the structure of the front portion A of the mound base. The structural struts 12 are illustrated by this exposed view. The covering is provided by a light aluminum sheet 32 which may be covered by a covering of plastic or similar material so that the structure of the base remains substantially hollow and the dirt of the pitcher's mound will be supported by the covering and overlay the entire base.

It will be noted from the drawings referred to that the peripheral wall 20 and the pitching rubber 8 are raised above their surroundings by 4 or 5 inches, but it should be understood that once the dirt is spread over the base, the top of the pitching rubber will be approximately level with the surface of the dirt, and the peripheral wall 20 and all other parts of the base will be covered.

In order to secure the two portions of the base in position, it may be desirable to drive stakes through the floor 22 into the ground beneath, or alternatively, to place stakes against the peripheral wall 20 at various locations around the perimeter. Alternatively, it may be desirable to provide the base with attached downwardly projecting spikes which will engage the ground whenever the base portions are put in place, but this would make it difficult to move the separated portions about to gain access to the tunnels designed to receive the forklift apparatus.

It will be readily appreciated that a level playing field may be adapted for baseball by transporting the two segments of the base separately by means of a forklift truck and placing them in the desired position. Because the access points for the tynes of a forklift truck are located in the dividing wall, the bulk of the weight of each section will be located nearest to the forklift truck and will therefore ensure that the centre of gravity is well positioned, and that the base segment is well secured for transportation by a forklift truck.

Of course, the two sections cannot be put in their assembled position because one portion would interfere with the access to the other portion but they can be placed in close proximity and easily moved by workers into the assembled position. The base can then be covered with the appropriate quantity of dirt to about a depth of approximately 4 or 5 inches to provide a pitcher's mound of the appropriate dimensions, configuration, and material for baseball.

When the field is desired for other purposes, the dirt can be scraped off and the segment separated and moved in the similar manner.

By virtue of this device most of the volume of a pitcher's mound is occupied by the base structure and all the weight and volume of dirt in a conventional pitcher's mound does not have to be removed.

Although the covering described is sheet aluminum with ridges, it could be a sheet of other material such as plastic, wood, tarred paper etc., and might be covered with some non-slippery finish of wire mesh.

It will, of course, be realized that numerous modifications and variations of the illustrated embodiment may be employed without departing from the inventive concept herein.

The embodiments of the invention which an exclusive property or privilege is claimed are defined as follows:

1. A portable base for a movable pitching mound comprising:

a network of structural elements having their bottom sides in a common generally horizontal plane, and defining a generally circular circumference;

a covering supported on said structural elements capable of supporting dirt for a pitcher's mound, and presenting a generally horizontal portion in the centre and inclined sides sloping downwards to a level near said horizontal plane at said circumference, said base being bisected into more than one parts along at least one mutual interface which is substantially upright and extending from one side of the circumference to the other.

2. The invention as claimed in claim 1 in which said base is divided into two parts along a substantially vertical plane through approximately the middle of said base, each part having a vertical structural partition adjacent the vertical dividing plane.

3. The invention as claimed in claim 2 in which each part has access openings in the structural partition to receive lifting means therein.

4. The invention as claimed in claim 3 in which said lifting means includes the tynes of a forklift vehicle.

5. The invention as claimed in claim 1 in which said cover is sheet aluminum having a pattern of substantially circular ridges extending around the inclined sides.

6. The invention as claimed in claim 2 in which said cover is sheet aluminum having a pattern of substantially circular ridges extending around the inclined sides.

7. The invention as claimed in claim 3 in which said cover is sheet aluminum having a pattern of substantially circular ridges extending around the inclined sides.

8. The invention as claimed in claim 4 in which said cover is sheet aluminum having a pattern of substantially circular ridges extending around the inclined sides.

9. The invention as claimed in claim 1 in which said cover has surface of metal mesh material.

10. The invention as claimed in claim 2 in which said cover has surface of metal mesh material.

11. The invention as claimed in claim 3 in which said cover has surface of metal mesh material.

12. The invention as claimed in claim 4 in which said cover has surface of metal mesh material.

* * * * *